US007477275B2

(12) United States Patent
Takahashi

(10) Patent No.: US 7,477,275 B2
(45) Date of Patent: Jan. 13, 2009

(54) THERMAL ACTIVATION APPARATUS AND PRINTER

(75) Inventor: Masanori Takahashi, Chiba (JP)

(73) Assignee: Seiko Instruments Inc. (JP)

( * ) Notice: Subject to any disclaimer, the term of this patent is extended or adjusted under 35 U.S.C. 154(b) by 141 days.

(21) Appl. No.: 11/515,651

(22) Filed: Sep. 5, 2006

(65) Prior Publication Data

US 2007/0058028 A1 Mar. 15, 2007

(30) Foreign Application Priority Data

Sep. 9, 2005 (JP) ..... 2005-262301

(51) Int. Cl.
*B41J 2/325* (2006.01)

(52) U.S. Cl. ..... 347/213

(58) Field of Classification Search ..... 347/213, 347/212, 215, 218, 220, 221, 222, 197, 171
See application file for complete search history.

(56) References Cited

U.S. PATENT DOCUMENTS 6,031,553 A * 2/2000 Nagamoto et al. ..... 347/171
6,388,692 B1 * 5/2002 Iwata et al. ..... 347/212
6,501,495 B1 * 12/2002 Ichikawa et al. ..... 347/171
6,867,792 B2 * 3/2005 Hoshino et al. ..... 347/218
2005/0191109 A1 9/2005 Takahashi

FOREIGN PATENT DOCUMENTS

EP 1052177 A1 11/2000
EP 1388421 A 2/2004
EP 1524193 A 4/2005
EP 1568613 A 8/2005
EP 1672606 A2 6/2006

* cited by examiner

*Primary Examiner*—K. Feggins
(74) *Attorney, Agent, or Firm*—Adams & Wilks

(57) ABSTRACT

To smoothly transport a heat-sensitive adhesive sheet having a heat-sensitive adhesive layer on one surface, while a damage or peeling off of the heat-sensitive adhesive layer is suppressed. A thermal activation apparatus includes a thermal head for heating a heat-sensitive adhesive layer, a platen roller for thermal activation opposed to the thermal head, a guide member, and insertion rollers for transporting the heat-sensitive adhesive sheet. The guide member has a coating layer made of fluororesin, and the heat-sensitive adhesive layer before being thermally activated slides on the coating layer, whereby the heat-sensitive adhesive sheet is guided toward the thermal head for thermal activation and the platen roller for thermal activation.

18 Claims, 7 Drawing Sheets

THERMAL ACTIVATION APPARATUS AND PRINTER

BACKGROUND OF THE INVENTION

1. Field of the Invention

The present invention relates to a thermal activation apparatus for a heat-sensitive adhesive sheet in which a heat-sensitive adhesive layer that usually exhibits non-adhesiveness and exhibits adhesiveness when thermally activated by heating is formed on one surface of a sheet-like substrate, and a printer provided with the thermal activation apparatus.

2. Related Background Art

Up to now, a heat-sensitive adhesive sheet having a heat-sensitive adhesive layer that exhibits adhesiveness by being heated has been put into practical use. Such a heat-sensitive adhesive sheet has advantages in that the sheet before being heated can be handled easily because there exists no adhesiveness, industrial waste is not produced since a peeling sheet is not required, and the like. In order to exhibit the adhesiveness of the heat-sensitive adhesive layer of the heat-sensitive adhesive sheet, the heat-sensitive adhesive layer may be heated by using a thermal head generally used as a recording head of a thermal printer. Further, in the case where a heat-sensitive recordable layer is provided on a surface of the heat-sensitive adhesive sheet on opposite side of the heat-sensitive adhesive layer, recording and thermal activation can be performed with a similar thermal head.

A printer has been produced for recording a desired character, number, image, etc. on a recordable layer of such a heat-sensitive adhesive sheet, cutting the recordable layer to a predetermined length, and allowing a heat-sensitive adhesive layer to exhibit adhesiveness, thereby producing an adhesive label displaying a price, a product name, etc., for example, by being attached to a product. This printer includes a recording apparatus for recording a desired character, number, symbol, or image on a recordable layer, a thermal activation apparatus for allowing a heat-sensitive adhesive layer to exhibit adhesiveness by thermally activating the heat-sensitive adhesive layer, a transport mechanism for transporting a heat-sensitive adhesive sheet, and a cutter mechanism for cutting the heat-sensitive adhesive sheet to a desired length to form a label. The recording apparatus and the thermal activation apparatus are provided with thermal heads having substantially the same configuration, and each provided with a platen roller which is placed so as to oppose to each other for supporting and transporting the heat-sensitive adhesive sheet.

SUMMARY OF THE INVENTION

The above-mentioned conventional printer is provided with a transport mechanism for transporting a heat-sensitive adhesive sheet. Usually, after recording is performed by a recording apparatus provided on an upstream side, a heat-sensitive adhesive sheet is transported under the condition that a recording surface faces upward, i.e., the heat-sensitive adhesive layer faces downward, so that a user can easily confirm the recorded contents and recorded state. Thus, the heat-sensitive adhesive layer passes above a guide member that forms a part of the transport mechanism. On an upstream side of a thermal head for thermal activation, the heat-sensitive adhesive layer has no adhesiveness, so the heat-sensitive adhesive layer does not adhere to the guide member. Nonetheless, the heat-sensitive adhesive layer has a large friction resistance, so a large transportation force is required for transporting the heat-sensitive adhesive layer at a correct pitch without a transportation roller idling. In particular, an edge of the guide member is jammed into the soft heat-sensitive adhesive layer before being heated, causing a large sliding load, thereby making it difficult to transport the heat-sensitive adhesive sheet.

Further, the heat-sensitive adhesive layer before being heated is relatively brittle, so the heat-sensitive adhesive layer may come into contact with the guide member to be damaged or peel off. In particular, when the edge of the guide member is jammed into the heat-sensitive adhesive layer as described above, the heat-sensitive adhesive layer is likely to peel off. Consequently, it becomes difficult to obtain a desired adhesiveness and a desired adhesive region in the thermal activation apparatus.

The object of the present invention is to provide a thermal activation apparatus capable of smoothly transporting a heat-sensitive adhesive sheet having a heat-sensitive adhesive layer on one surface, and suppressing the damage or peeling off of the heat-sensitive adhesive layer, and a printer including the thermal activation apparatus.

According to the present invention, a thermal activation apparatus includes: a thermal head thermally activating a heat-sensitive adhesive layer of a heat-sensitive adhesive sheet, in which the heat-sensitive adhesive layer is formed on one surface of a sheet-like substrate, by heating; a platen for thermal activation placed in opposition to the thermal head for thermal activation, which allows the heat-sensitive adhesive sheet to travel between the thermal head for thermal activation and the platen for thermal activation; and a guide member, in which at least a portion is made of fluororesin, and the portion made of the fluororesin comes into contact with the heat-sensitive adhesive layer of the heat-sensitive adhesive sheet to guide the heat-sensitive adhesive sheet. According to this structure, it is possible for the heat-sensitive adhesive sheet to smoothly travel on the well-sliding fluororesin.

In particular, when a portion of the guide member that comes into contact with the heat-sensitive adhesive layer is formed in a shape without an edge, the increase in a sliding load and the peeling off or damage of the heat-sensitive adhesive layer due to the jamming of an edge into a relatively soft heat-sensitive adhesive layer can be prevented.

At least a part of the surface of the guide member may be coated or applied with fluororesin, or a sheet made of fluororesin may be attached to at least a part of the surface. Alternatively, the guide member may be formed of fluororesin.

In the case where the guide member is placed on an upstream side of a thermal head for thermal activation with respect to the transporting direction of the heat-sensitive adhesive sheet, the above-mentioned configuration is particularly effective.

The printer of the present invention includes: a thermal activation apparatus with any of the above configurations; and a recording apparatus including a recording thermal head for recording a recordable layer formed on the other surface of a sheet-like substrate by heating, and a recording platen for passing a heat-sensitive adhesive sheet between the recording thermal head and the recording platen, which is placed in opposition to the recording thermal head. The recording apparatus is placed on an upstream side of the thermal activation apparatus with respect to the transporting direction of the heat-sensitive adhesive sheet.

According to the present invention, the heat-sensitive adhesive sheet can be traveled smoothly. Further, in the case where a portion of the guide member that comes into contact with the heat-sensitive adhesive layer is formed in a shape without an edge, the increase in a sliding load and the peeling off or damage of the heat-sensitive adhesive layer can be prevented.

DETAILED DESCRIPTION OF THE PREFERRED EMBODIMENTS

Hereinafter, the present invention will be described by way of an embodiment with reference to the accompanying drawings.

Figure 1:
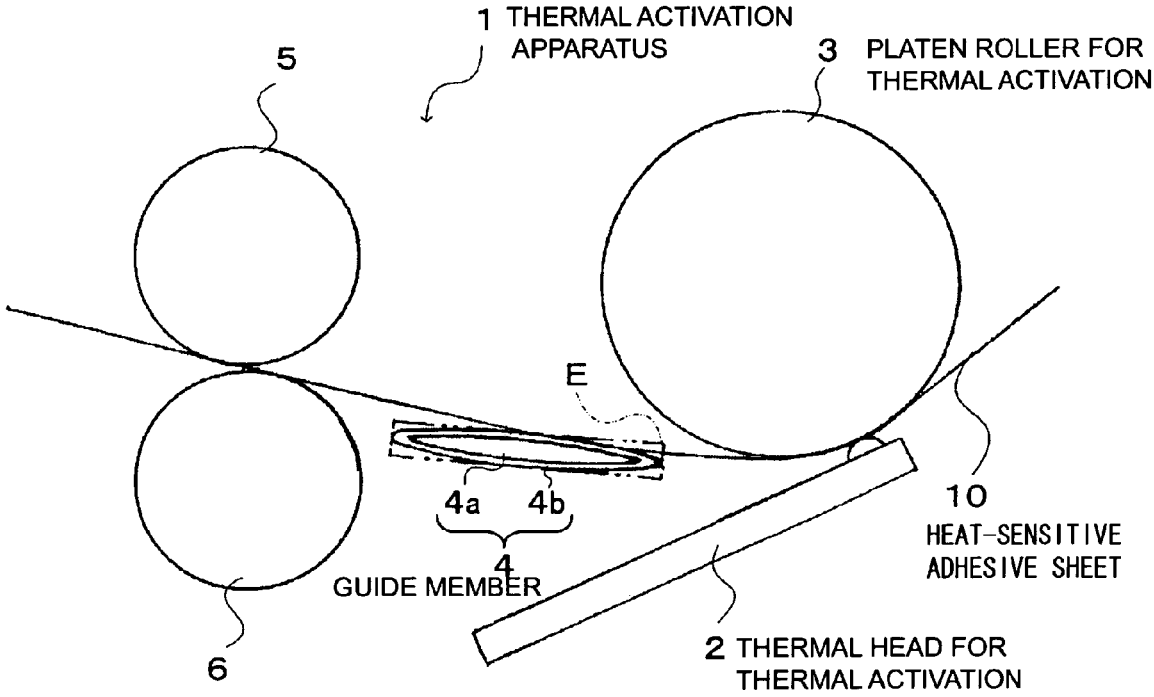
FIG. 1 is an entire structural view showing a thermal activation apparatus of an embodiment of the present invention.

FIG. 1 is a schematic cross-sectional view showing a thermal activation apparatus 1 of the present invention. The thermal activation apparatus 1 of this embodiment includes a thermal head 2 for thermal activation having a plurality of heater elements (not shown) placed to form lines in a width direction, a platen roller 3 for thermal activation that is urged toward the thermal head 2 for thermal activation with pressure, a guide member 4 for guiding a heat-sensitive adhesive sheet 10, and a pair of insertion rollers (transportation rollers) 5 and 6 for delivering the heat-sensitive adhesive sheet 10 into the thermal activation apparatus 1 while sandwiching the heat-sensitive adhesive sheet 10 therebetween.

Figure 3:
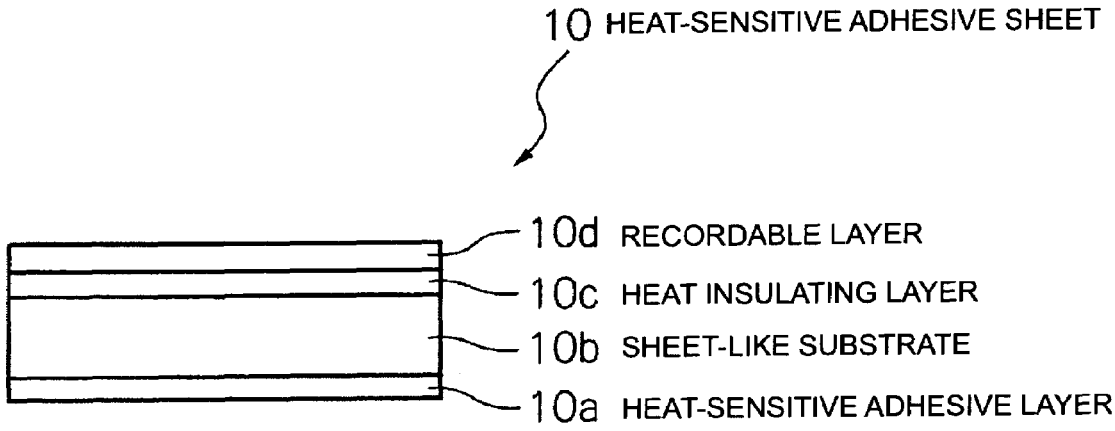
FIG. 3 is an enlarged cross-sectional view showing an example of a heat-sensitive adhesive sheet used in the present invention.

The thermal head 2 for thermal activation has the same configuration as that of a recording head of a known thermal printer, such as a configuration in which a protective film of crystallized glass is provided on the surfaces of a plurality of heat elements formed on a ceramic substrate. In this configuration, heating is performed by using a number of small heater elements, i.e., heat elements. Therefore, this configuration has an advantage in that a temperature distribution is likely to be uniform over a wide range compared to that of the configuration in which heating is performed using one, or a small number of, large heater element. The thermal head 2 for thermal activation is positioned so as to come into contact with a heat-sensitive adhesive layer 10*a* of the heat-sensitive adhesive sheet 10 as shown in FIG. 3 and the platen roller 3 for thermal activation is urged toward the thermal head 2 for thermal activation with pressure. Then, the guide member 4 and the pair of insertion rollers 5 and 6 for guiding the heat-sensitive adhesive sheet 10 between the thermal head 2 for thermal activation and the platen roller 3 for thermal activation are placed on an upstream side of the thermal head 2 for thermal activation and the platen roller 3 for thermal activation.

Figure 2:
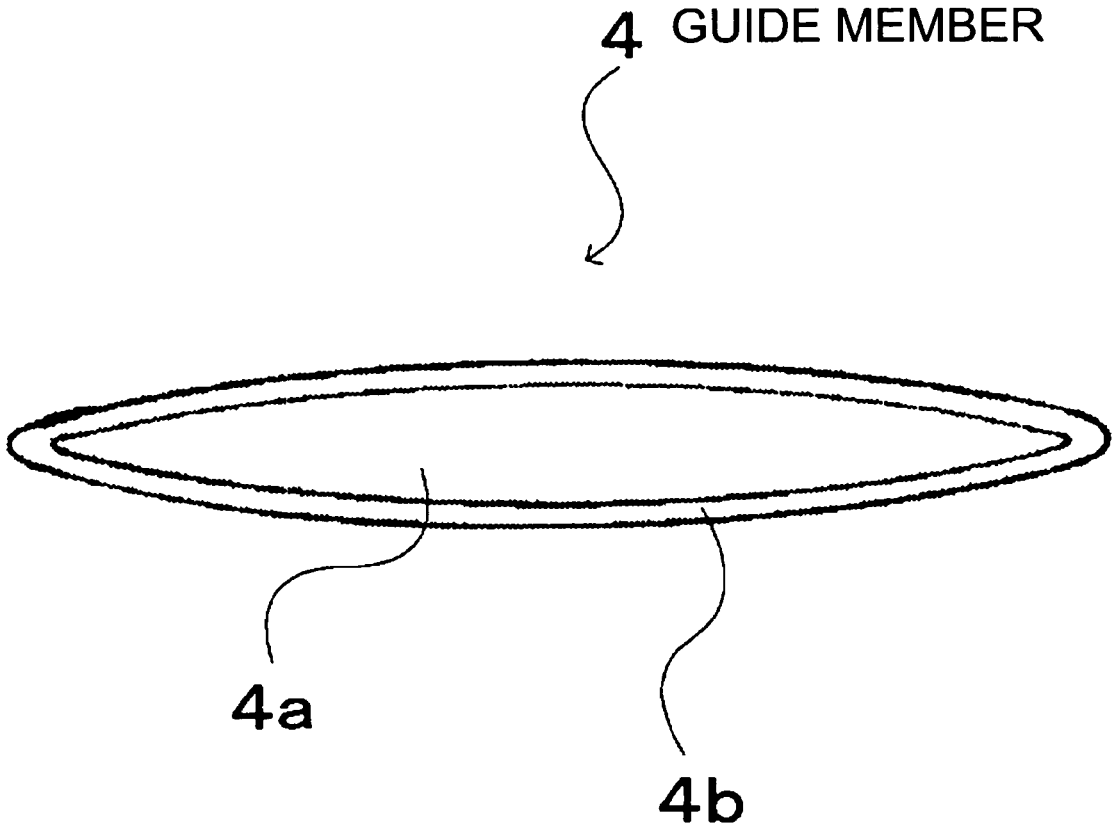
FIG. 2 is an enlarged cross-sectional view showing a guide member of the thermal activation apparatus shown in FIG. 1.

As shown in FIG. 2, the guide member 4 of this embodiment is formed of a synthetic resin molding 4*a* and a coating layer 4*b* on the surface thereof, and the coating layer 4*b* has a configuration in which the surface of the synthetic resin molding 4*a* is coated with a fluororesin coating material. An upper surface of the guide member 4, which may come into contact with the heat-sensitive adhesive sheet 10, is formed without an edge, i.e., an angled portion or a ridge line so as to have, for example, an oval cross-section with a rounded or curved end. Further, the guide member 4 has a smooth coating layer 4*b* made of a fluororesin coating material as described above.

For example, as shown in FIG. 3, the heat-sensitive adhesive sheet 10 used in this embodiment has a configuration in which a heat insulating layer 10*c* and a heat-sensitive coloring layer, i.e., recordable layer, 10*d* are formed on a surface of a sheet-like substrate 10*b*, and the heat-sensitive adhesive layer 10*a* is formed on an opposite surface of the sheet-like substrate 10*b*. The heat-sensitive adhesive layer 10*a* has a configuration in which a heat-sensitive adhesive mainly containing thermoplastic resin, solid plastic resin, or the like is applied, and solidified by drying. However, the heat-sensitive adhesive sheet 10 is not limited to this configuration, and can be variously modified as long as it has the heat-sensitive adhesive layer 10*a*. For example, a configuration in which the heat-sensitive adhesive sheet 10 does not have the heat insulating layer 10*c* can be used. Another configuration of the heat-sensitive adhesive sheet 10 in which a protective layer (not shown) or a colored recording layer, i.e., previously recorded layer (not shown), is provided can be used. Another configuration of the heat-sensitive adhesive sheet 10 in which a thermal coat layer is provided can also be used.

In the thermal activation apparatus of this embodiment with the above-mentioned configuration, the heat-sensitive adhesive sheet 10 is driven with a pair of insertion rollers 5 and 6, and guided by the guide member 4, thereby being inserted between the thermal head 2 for thermal activation and the platen roller 3 for thermal activation. Then, while the heat-sensitive adhesive sheet 10 is being pressed against the thermal head 2 for thermal activation by the platen roller 3 for thermal activation, the thermal head 2 for thermal activation is operated to generate heat, whereby the heat-sensitive adhesive layer 10*a* in contact with the thermal head 2 for thermal activation is heated to be thermally activated. Concurrently, the platen roller 3 for thermal activation rotates, the heat-sensitive adhesive sheet 10 is transported, and the entire surface of the heat-sensitive adhesive layer 10*a* travels while being in contact with the thermal head 2 for thermal activation, whereby the adhesiveness is exhibited over the entire surface of the heat-sensitive adhesive layer 10*a* on one surface of the heat-sensitive adhesive sheet 10.

Thus, even if the heat-sensitive adhesive layer 10*a* slides while being in contact with the upper surface of the guide member 4 when the heat-sensitive adhesive sheet 10 runs, because the surface of the coating layer 4*b* made of a fluororesin coating material is smooth, the heat-sensitive adhesive sheet 10 can smoothly move without receiving large resistance. Further, there is no edge on a surface of the coating layer 4*b* of the guide member 4 which may come into contact with the heat-sensitive adhesive sheet 10, so the heat-sensitive adhesive layer 10*a* of the heat-sensitive adhesive sheet 10 will not be chipped or peeled off to lead damage by being caught by the edge.

As schematically represented by alternate double dot and dash line in FIG. 1, in the case where a rectangular guide member is provided, an edge E thereof may catch the heat-sensitive adhesive layer 10*a* of the heat-sensitive adhesive sheet 10 to damage. However, even when the guide member 4 of this embodiment is placed at the same position as that of the rectangular guide member, since there is no edge, the heat-sensitive adhesive layer 10*a* will not be damaged. Further, in the configuration shown in FIG. 1, a portion of the heat-sensitive adhesive sheet 10, between a portion held by the insertion rollers 5 and 6 and a portion held by the thermal head 2 for thermal activation, and the platen roller 3 for thermal activation, is pressed against the underlying guide member 4. In such a configuration, the effect of preventing the damage of the heat-sensitive adhesive layer 10*a* by the guide member 4 of the present invention is extremely high.

Figure 4:
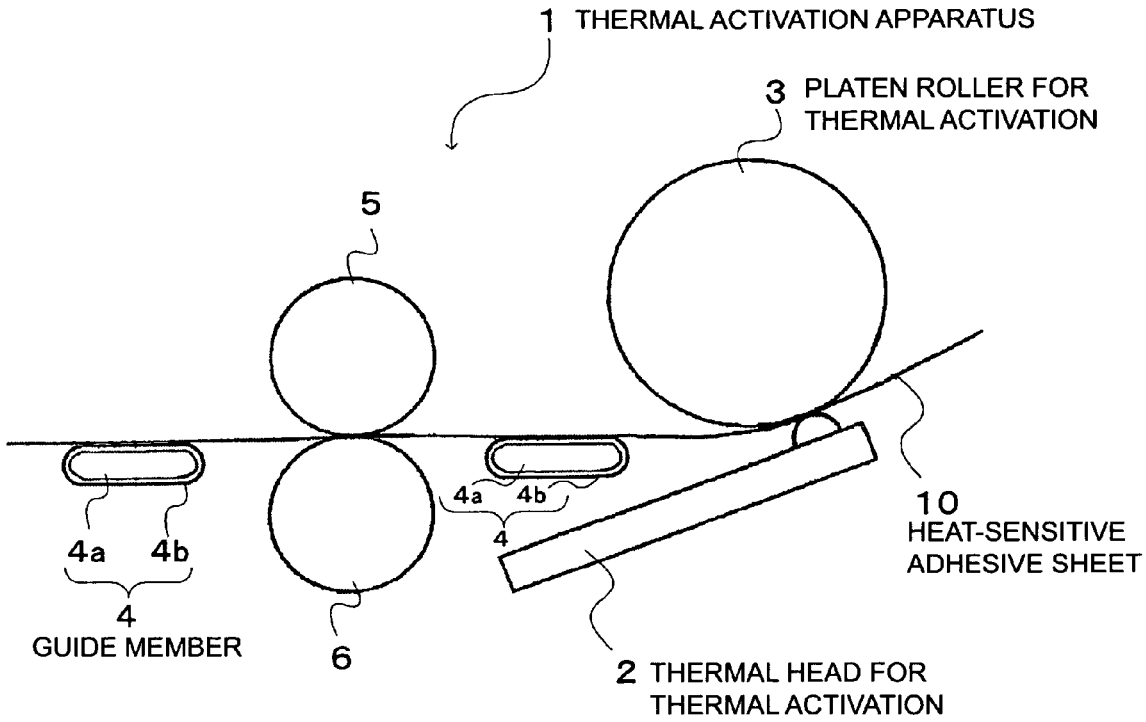
FIG. 4 is an entire structural view showing another example of the thermal activation apparatus.

The thermal activation apparatus of the present invention is not limited to the arrangement configuration shown in FIG. 1, and may have a configuration in which, as shown in FIG. 4, the guide member 4 is also placed on an upstream side of the insertion rollers 5 and 6. In this configuration, the heat-sensitive adhesive sheet 10 moves in a substantially horizontal direction until reaching the vicinity of the thermal head 2 for thermal activation and the platen roller 3 for thermal activation. Therefore, the guide member 4 is formed in such a manner that the upper and lower surfaces are substantially horizontal, and the cross-sectional shape is oval. This guide member 4 also exhibits the same effect as that described above.

Next, a printer incorporated in the thermal activation apparatus 1 of the present invention as described above will be described with reference to FIG. 5.

Figure 5:
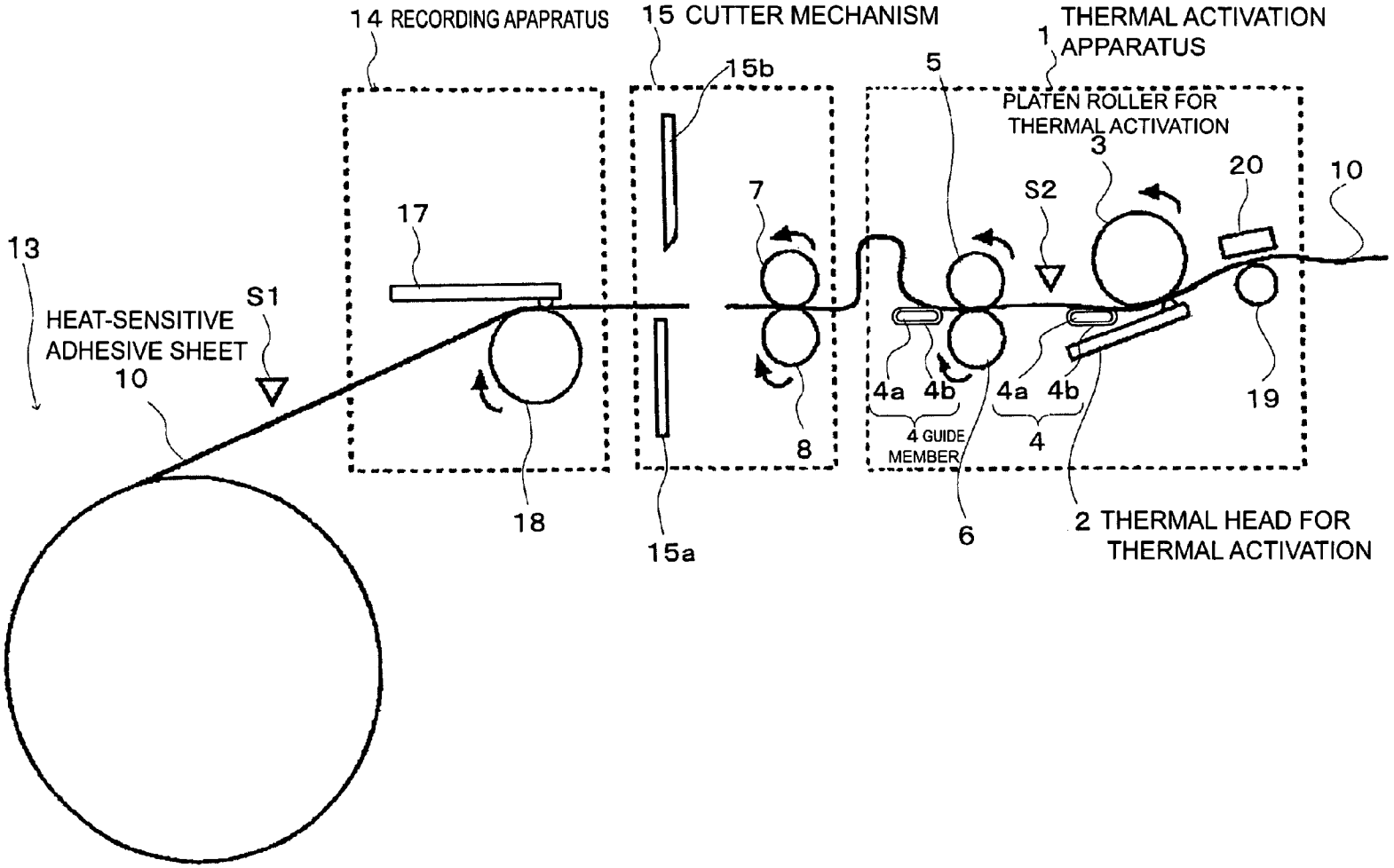
FIG. 5 is an entire structural view showing a printer including the thermal activation apparatus shown in FIG. 4.

The basic configuration of a printer for a heat-sensitive adhesive sheet shown in FIG. 5 will be described briefly. The printer includes a roll accommodating mechanism 13 for holding the heat-sensitive adhesive sheet 10 wound in a roll shape, a recording apparatus 14 for recording the recordable layer 10*d* shown in FIG. 3 of the heat-sensitive adhesive sheet 10, a cutter mechanism 15 for cutting the heat-sensitive adhesive sheet 10 to a predetermined length, and the thermal activation apparatus 1 with the configuration shown in FIG. 4 as described above, for thermally activating the heat-sensitive adhesive layer 10*a* shown in FIG. 3 of the heat-sensitive adhesive sheet 10.

The roll accommodating mechanism 13 holds a roll body of the heat-sensitive adhesive sheet 10 rotatably.

The recording apparatus 14 includes a thermal head 17 for recording having a plurality of heater elements made of relatively small resistors arranged in a width direction, i.e., vertical to. FIG. 5, so as to perform dot recording, and a platen roller 18 for recording is urged toward the thermal head 17 for recording with pressure. The thermal head 17 for recording is positioned so as to come into contact with the recordable layer 10*d* of the heat-sensitive adhesive sheet 10 sent from the roll accommodating mechanism 13, and the platen roller 18 for recording is urged toward the thermal head 17 for recording with pressure. The thermal head 17 for recording has the same configuration as that of the thermal head 2 for thermal activation of the above-mentioned thermal activation apparatus 1, that is, the same configuration as that of a recording head of a known thermal printer such as a configuration in which a protective film of crystallized glass is provided on surfaces of a plurality of heat elements formed on a ceramic substrate. Thus, by configuring the thermal head 2 f or thermal activation in the same way as in the thermal head 17 for recording, cost can be reduced by using common components.

The cutter mechanism 15 cuts the heat-sensitive adhesive sheet 10, on which recording is performed by the recording apparatus 14, into a predetermined length to form a label, and includes a movable blade 15*b* that is operated by a driving source (not shown) such as an electric motor, a fixed blade 15*a* opposed to the movable blade 15*b*, and the like. Further, the cutter mechanism 15 is provided with a pair of delivery rollers 7 and 8 for discharging the heat-sensitive adhesive sheet 10 from the cutter mechanism 15, in addition to a pair of blades 15*a* and 15*b*. The heat-sensitive adhesive sheet 10 is sent to the thermal activation apparatus 1 in a latter stage while being sandwiched between the delivery rollers 7 and 8. The heat-sensitive adhesive sheet 10 may be sent from the cutter mechanism 15 to the thermal activation apparatus 1, by using the transportation force of the platen roller 18 for recording of the recording apparatus 14, without providing the delivery rollers 7 and 8.

The thermal activation apparatus 1 is provided on a downstream side of the cutter mechanism 15. As described above, the thermal activation apparatus 1 includes the thermal head 2 for thermal activation, the platen roller 3 for thermal activation, the guide member 4, and the insertion rollers 5 and 6. Further, the thermal activation apparatus 1 is provided with a discharge roller 19 and a discharge guide 20 for discharging the heat-sensitive adhesive sheet 10 having traveled between the thermal head 2 for thermal activation and the platen roller 3 for thermal activation to the outside of the printer.

There is provided a configuration capable of loosening the heat-sensitive adhesive sheet 10 between the delivery rollers 7 and 8 of the cutter mechanism 15 and the insertion rollers 5 and 6 of the thermal activation apparatus 1 by adjusting the rotations of the delivery rollers 7 and 8 and the insertion rollers 5 and 6. In view of this configuration, description will be made. When the heat-sensitive adhesive sheet 10 is cut with the blades 15*a* and 15*b*, if a portion to be cut is not stopped, a cutting operation cannot be performed. In other words, the traveling heat-sensitive adhesive sheet 10 cannot be cut smoothly with the blades 15*a* and 15*b*. On the other hand, when the transportation of the entire heat-sensitive adhesive sheet 10 is halted, the heat-sensitive adhesive layer 10*a* thermally activated in the thermal activation apparatus 1 adheres to the thermal head 2 for thermal activation in a halted state and cannot travel. Thus, when the heat-sensitive adhesive sheet 10 is located at a position opposed to the thermal head 2 for thermal activation, the heat-sensitive adhesive sheet 10 needs to be continuously traveled at a speed in which the heat-sensitive adhesive layer 10*a* does not adhere to the thermal head 2 for thermal activation. On the other hand, when a portion to be cut of the thermal head 2 for thermal activation reaches a position opposed to the blades 15*a* and 15*b*, it is necessary to suspended the traveling to cut the portion.

Prior to the thermal activation, at a time when the front end of the heat-sensitive adhesive sheet 10 has not reached the thermal head 2 for thermal activation, the rotation of the insertion rollers 5 and 6 is set to be slower than that of the delivery rollers 7 and 8, whereby the heat-sensitive adhesive sheet 10 is loosened between the insertion rollers 5 and 6 and the delivery rollers 7 and 8. By operating so, the heat-sensitive adhesive sheet 10 can be continuously transported in the thermal activation apparatus 1 without being halted, while the operation of heat-sensitive adhesive sheet 10 is partially suspended at a position opposed to the blades 15*a* and 15*b*. To be specific, a loosened portion is formed by presetting the difference in rotation speed between the delivery rollers 7 and 8 and the insertion rollers 5 and 6, and then, the insertion rollers 5 and 6 are rotated at an ordinary rotation speed, whereby thermal activation processing is performed with the thermal activation apparatus 1 on a downstream side of the insertion rollers 5 and 6. In the course of this, when the position to be cut of the heat-sensitive adhesive sheet 10 reaches the position opposed to the blades 15*a* and 15*b*, the operation of the delivery rollers 7 and 8 are suspended and cut smoothly with the blades 15*a* and 15*b*. At this time, although the delivery rollers 7 and 8 are still, a portion of the heat-sensitive adhesive sheet 10 on a downstream side of the insertion rollers 5 and 6 can continuously travel only by the loosened portion. By operating so, a predetermined portion of the heat-sensitive adhesive sheet 10 can be cut smoothly with the cutter mechanism 15 while the heat-sensitive adhesive sheet 10 is prevented from becoming unable to travel by adhering to the thermal head 2 for thermal activation. The magnitude of the looseness is set to such a degree that the cutting is completed and the rotation of the delivery rollers 7 and 8 is restarted to rotate concurrently with the insertion rollers 5 and 6, before the looseness is completely eliminated. The guide member 4 functions to regulate the loosening direction, and to allow the heat-sensitive adhesive sheet 10 to smoothly travel from the loosened portion to the insertion rollers 5 and 6.

In the above description, the loosened portion is formed by previously setting the difference in rotation speed between the delivery rollers 7 and 8 and the insertion rollers 5 and 6. However, the loosened portion can also be formed by suspending operation of the insertion rollers 5 and 6 at a time when the front end of the heat-sensitive adhesive sheet 10 has not reached the thermal head 2 for thermal activation. In any case, by previously forming a loosened portion, at a time when the position to be cut of the heat-sensitive adhesive sheet 10 reaches a position opposed to the blades 15*a* and 15*b*, the operation of the delivery rollers 7 and 8 is suspended immediately and cutting can be performed with the blades 15*a* and 15*b*. The timing of this cutting can be set freely irrespective of the thermal activation operation and the like.

Further, the printer is provided with detectors S1 and S2 such as optical sensors for detecting the presence/absence of the heat-sensitive adhesive sheet 10 at an inlet of the recording apparatus 14 and before the thermal head 2 for thermal activation of the thermal activation apparatus 1. Further, although not shown, the printer has a control apparatus that is capable of transmitting/receiving a signal with respect to the detectors S1 and S2; drives the respective rollers 3, 5, 6, 7, 8, 18, and 19 constituting the transport mechanism, the movable blade 15*b*, the thermal head 17 for recording, the thermal head 2 for thermal activation, and the like; and controls the operations thereof.

A method of producing a desired adhesive label made of the heat-sensitive adhesive sheet 10, by using the printer with the above-mentioned configuration, will be described.

First, the heat-sensitive adhesive sheet 10 pulled out from the roll accommodating mechanism 13 is inserted between the thermal head 17 for recording and the platen roller 18 for recording of the recording apparatus 14. A recording signal is supplied from the control apparatus to the thermal head 17 for recording, and a plurality of heater elements of the thermal head 17 for recording are selectively driven at an appropriate timing to generate heat, whereby recording is performed on the recordable layer 10*d* of the heat-sensitive adhesive sheet 10. The platen roller 18 for recording is driven to rotate in synchronization with the driving of the thermal head 17 for recording, and the heat-sensitive adhesive sheet 10 is transported in a direction orthogonal to a direction in which the heater elements of the thermal head 17 for recording are arranged, e.g., in a direction vertical to the lines of the heater elements. To be specific, the recording of one line by the thermal head 17 for recording and the transportation of a predetermined amount corresponding to one line of the heat-sensitive adhesive sheet 10 by the platen roller 18 for recording are repeated alternately, whereby a desired character, number, symbol, image, and the like are recorded on the heat-sensitive adhesive sheet 10.

The heat-sensitive adhesive sheet 10 thus recorded travels between the movable blade 15*b* and the fixed blade 15*a* of the cutter mechanism 15 to reach the delivery rollers 7 and 8. Then, as described above, at a time when the front end of the heat-sensitive adhesive sheet 10 has not reached the thermal head 2 for thermal activation, by suspending the operation of the insertion rollers 5 and 6 of the thermal activation apparatus 1, or reducing the speed thereof compared to that of the operation of the delivery rollers 7 and 8, the heat-sensitive adhesive sheet 10 is loosened by a required amount.

Next, the heat-sensitive adhesive sheet 10, on which required recording has been performed as described above, is sent to the thermal activation apparatus 1 by rotating the insertion rollers 5 and 6. Then, in the thermal activation apparatus 1, the control apparatus drives the thermal head 2 for thermal activation with the heat-sensitive adhesive sheet 10 sandwiched between the thermal head 2 for thermal activation and the platen roller 3 for thermal activation, and the heat-sensitive adhesive layer 10*a* in contact with the thermal head 2 for thermal activation is heated to be thermally activated. Concurrently, the platen roller 3 for thermal activation is rotated to send the heat-sensitive adhesive sheet 10, and the heat-sensitive adhesive sheet 10 is allowed to travel while the entire surface of the heat-sensitive adhesive layer 10*a* being in contact with the thermal head 2 for thermal activation.

When the position to be cut of the heat-sensitive adhesive sheet 10 has reached the position opposed to the blades 15*a* and 15*b* while the heat-sensitive adhesive sheet 10 is being transported and thermally activated, operation of the delivery rollers 7 and 8 are halted immediately and cutting by the blades 15*a* and 15*b* is performed. At this time, the insertion rollers 5 and 6 continue to rotate, and a portion of the heat-sensitive adhesive sheet 10 on a downstream side of the delivery rollers 7 and 8 continues to travel without halting while gradually eliminating the loosened portion.

Thus, desired recording is performed on one surface and adhesiveness is exhibited on the opposite surface, whereby an adhesive label made of the heat-sensitive adhesive sheet 10 cut into a predetermined length is completed. Then, by rotating the discharge roller 19, the label-like heat-sensitive adhesive sheet 10 is guided with the discharge guide 20 to be discharged out of the printer.

In this printer, it is preferable to transport the heat-sensitive adhesive sheet 10 with the recorded portion, i.e., the recordable layer 10*d*, directed upward so that a user can easily confirm the recorded contents and the recorded state after recording is performed with the recording apparatus 14. For this purpose, the heat-sensitive adhesive layer 10*a* slides on the guide member 4. However, the guide member 4 has a small friction resistance owing to the coating layer 4*b* made of a fluororesin coating material, so the guide member 4 can slide smoothly. In particular, there is no edge in a portion of the coating layer 4*b* of the guide member 4 which comes into contact with the heat-sensitive adhesive layer 10*a*Therefore, the edge will not be jammed into the heat-sensitive adhesive layer 10*a* to increase a sliding load. Further, owing to the absence of an edge in the portion of the coating layer 4*b* which comes into contact with the heat-sensitive adhesive layer 10*a*, the heat-sensitive adhesive layer 10*a* will not be caught by an edge to be chipped or peeled off to be damaged.

As described above, owing to the coating layer 4*b* made of a fluororesin coating material of the guide member 4, the heat-sensitive adhesive sheet 10 can be transported smoothly at a correct pitch. Further, the coating layer 4*b* can prevent the heat-sensitive adhesive layer 10*a* from being damaged or peeled to make it impossible to form a desired adhesive portion.

In the present invention, as described above, the coating layer 4*b* made of a fluororesin coating material is formed on the guide member 4. In comparison with this, a coating layer made of silicon resin that may be used as an example of a coating material will be discussed. The coating layer made of silicon resin has no gluability with respect to a substance having high adhesion. Thus, such a coating layer can be prevented from adhering to, for example, the heat-sensitive adhesive layer 10*a* after being thermally activated. Therefore, it is considered to be effective to form a coating layer made of silicon resin on a member positioned on a downstream side of the thermal head 2 for thermal activation. However, the problems concerned in the present invention are the transportability of the heat-sensitive adhesive sheet 10 on an upstream side of the thermal head 2 for thermal activation, that is, the friction resistance of the heat-sensitive adhesive layer 10*a* before being thermally activated. Because the heat-sensitive adhesive layer 10*a* before being thermally activated has not developed adhesion, needless to say, the effect of preventing the adhesion by the coating layer made of silicon resin is substantially meaningless. In addition, there is even a possibility that the coating layer made of silicon resin increases the friction resistance with respect to the heat-sensitive adhesive layer 10*a* before being thermally activated, and inhibit smooth transportation of the heat-sensitive adhesive sheet 10 on an upstream side of the thermal head 2 for thermal activation. In contrast, in the above-mentioned embodiment, the coating layer 4*b* made of a fluororesin coating material is provided on the guide member 4. The coating layer 4*b* made of a fluororesin coating material is extremely effective for decreasing the friction resistance with respect to the heat-sensitive adhesive layer 10*a* before being thermally activated, and achieving the smooth transportation of the heat-sensitive adhesive sheet 10 on the upstream side of the thermal head 2 for thermal activation. Thus, according to the present invention, the guide member 4 extremely suitable for being placed on an upstream side of the thermal head 2 for thermal activation is provided. Further, it is preferable to configure a plurality of guide members 4, placed on an upstream side of the thermal head 2 for thermal activation and at various positions corresponding to the heat-sensitive adhesive layer 10*a* side of the heat-sensitive adhesive sheet 10 to be transported, in the same way as the configuration of the present invention described above without being limited to the positions shown in FIGS. 1 and 4. In other words, as shown in FIG. 1, it is preferable to configure, in the same way as in the configuration of the present invention, the guide members placed in the recording apparatus 14 and the cutter mechanism 15, as well as the insertion rollers 5 and 6 and the guide member 4 between the thermal head 2 for thermal activation and the platen roller 3 for thermal activation.

Figure 6:
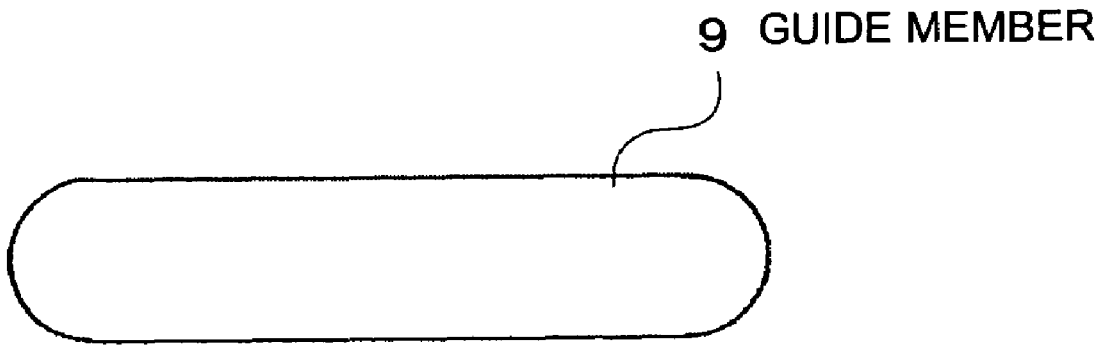
FIG. 6 is an enlarged cross-sectional view showing another example of a guide member.

In the embodiment as described above, the guide member 4 having the coating layer 4*b* made of a fluorine based coating material is provided. However, the guide member 4 may have a configuration such that the surface of a synthetic resin molding 4*a* is coated with a coating material made of fluororesin (not shown), or a sheet made of fluororesin is attached thereto (not shown). Further, as shown in FIG. 6, the same effect as that described above can be obtained even with a guide member 9 having no coating layer, in which a synthetic resin molding itself is made of fluororesin.

Figure 7A:
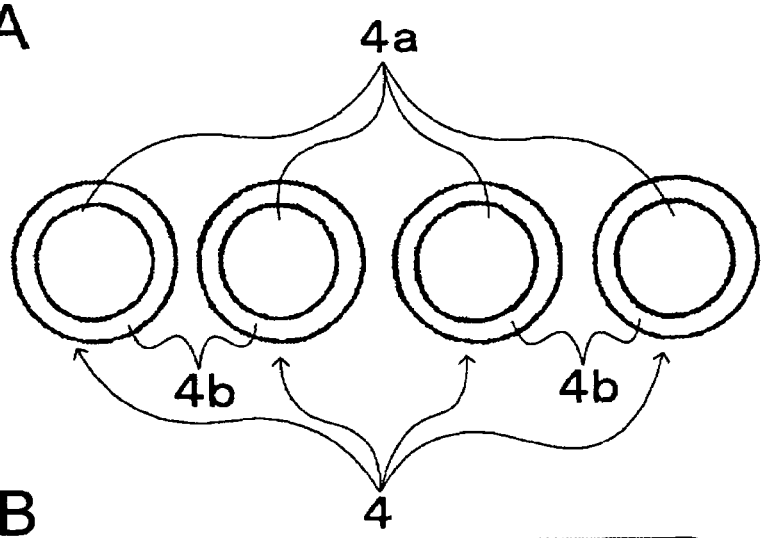
FIG. 7A and FIG. 7B are enlarged cross-sectional view showings still another example of a guide member.
Figure 7B:
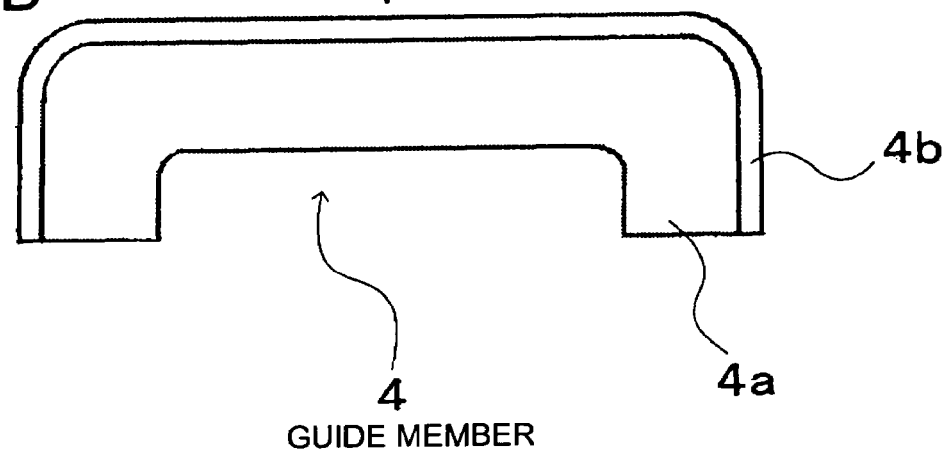

The guide member 4 of the present invention is not limited to the above-mentioned configuration. For example, as the guide member 4, various configurations without an edge at a portion that may come into contact with the heat-sensitive adhesive layer 10*a* such as a plurality of cylindrical guide members 4 having a circular cross-section as shown in FIG. 7A and the guide member 4 having a shape in which front and back ends are bent or curved downward as shown in FIG. 7B can be preferably adopted. Although not described in detail, in each of these guide members 4, at least the surface coming into contact with the heat-sensitive adhesive layer 10*a* is composed of fluororesin. Further, the present invention is not limited regarding the configuration other than the guide member of the thermal activation apparatus 1.

What is claimed is:

1. A thermal activation apparatus, comprising:

a thermal head for thermally activating a heat-sensitive adhesive layer of a heat-sensitive adhesive sheet, the heat-sensitive adhesive sheet having the heat-sensitive adhesive layer on one side of a sheet-like substrate;

a platen for thermal activation which is placed in opposition to the thermal head and which allows the heat-sensitive adhesive sheet to travel between the thermal head and the platen;

a guide member for guiding the heat-sensitive adhesive sheet between the thermal head and the platen roller, the guide member being placed on an upstream side of the thermal head and the platen with respect to a transporting direction of the heat-sensitive adhesive sheet, and the guide member having at least a portion formed from fluororesin that comes into contact with the heat-sensitive adhesive layer of the heat-sensitive adhesive sheet to guide the heat-sensitive adhesive sheet; and a pair of insertion rollers placed on an upstream side of the guide member with respect to the transporting direction of the heat-sensitive adhesive sheet and which sandwich therebetween the heat-sensitive adhesive sheet for delivering the heat-sensitive adhesive sheet between the thermal head and the platen.

2. A thermal activation apparatus according to claim 1; wherein the portion of the guide member which comes into contact with the heat-sensitive adhesive layer is formed in a shape without an edge.

3. A thermal activation apparatus according to claim 1; wherein at least a part of a surface of the guide member is coated or applied with the fluororesin.

4. A thermal activation apparatus according to claim 1; wherein a sheet made of the fluororesin is attached to at least a part of a surface of the guide member.

5. A thermal activation apparatus according to claim 1; wherein the guide member is molded of the fluororesin.

6. A printer, comprising:

a thermal activation apparatus according to claim 1;

a recording apparatus including a thermal head for recording a recordable layer of the heat-sensitive adhesive sheet, the heat-sensitive adhesive sheet having the recordable layer on the other side of the sheet-like substrate; and a platen for recording which is placed in opposition to the thermal head for recording and which allows the heat-sensitive adhesive sheet to travel between the thermal head for recording and the platen for recording.

7. The printer according to claim 6; wherein the recording apparatus is placed on an upstream side of the thermal activation apparatus with respect to the transporting direction of the heat-sensitive adhesive sheet.

8. A thermal activation apparatus comprising:

a thermal head that thermally activates a heat-sensitive adhesive layer provided on one side of a heat-sensitive adhesive sheet;

a platen disposed opposite to the thermal head and cooperating therewith to allow the heat-sensitive adhesive sheet to travel in a transporting direction between the thermal head and the platen while the thermal head thermally activates the heat-sensitive adhesive layer;

two insertion rollers disposed opposite one another and that sandwich therebetween the heat-sensitive adhesive sheet to deliver the heat-sensitive adhesive sheet in the transporting direction between the thermal head and the platen; and a guide member disposed on a downstream side of the two insertion rollers and on an upstream side of the thermal head and the platen with respect to the transporting direction of the heat-sensitive adhesive sheet and that guides the heat-sensitive adhesive sheet between the thermal head and the platen, the guide member having a surface portion made of fluororesin that comes into slidable contact with the heat-sensitive adhesive layer to reduce friction resistance during guiding of the heat-sensitive adhesive sheet.

9. A thermal activation apparatus according to claim 8; wherein the guide member has a generally oval cross section with two curved ends, one curved end facing toward the two insertion rollers and the other curved end facing toward the thermal head and the platen.

10. A thermal activation apparatus according to claim 9; wherein the guide member has a coating layer composed of fluororesin, a part of the coating layer constituting the guide member surface portion.

11. A thermal activation apparatus according to claim 8; wherein the guide member has a coating layer composed of fluororesin, a part of the coating layer constituting the guide member surface portion.

12. A thermal activation apparatus according to claim 8; wherein the guide member has a sheet made of fluororesin attached thereto, the fluororesin sheet constituting the guide member surface portion.

13. A thermal activation apparatus according to claim 8; wherein the guide member comprises a molded structure composed of fluororesin.

14. A thermal activation apparatus according to claim 8; wherein the guide member comprises one or more cylindrical members each having opposite ends that are curved downwardly, one end facing toward the two insertion rollers and the other end facing toward the thermal head and the platen.

15. A thermal activation apparatus according to claim 8; wherein the surface portion of the guide member that comes into slidable contact with the heat-sensitive layer is free of edges.

16. A thermal activation apparatus according to claim 8; wherein the two insertion rollers are disposed vertically one above the other.

17. A thermal activation apparatus according to claim 16; wherein at least one of the two insertion rollers is a rotationally driven roller.

18. A thermal activation apparatus according to claim 8; wherein at least one of the two insertion rollers is a rotationally driven roller.

* * * * *